United States Patent [19]

Bross

[11] Patent Number: 4,595,246

[45] Date of Patent: Jun. 17, 1986

[54] INTERLOCKING SPACER SYSTEM

[75] Inventor: Elly Bross, Montreal, Canada

[73] Assignee: The Stanbel Group, Montreal, Canada

[21] Appl. No.: 650,068

[22] Filed: Sep. 13, 1984

[51] Int. Cl.[4] ..... A47B 87/00; B65D 1/24

[52] U.S. Cl. ..... 312/330 R; 312/111; 312/263; 220/22.3; 217/30; 217/31; 108/60

[58] Field of Search ..... 312/330 R, 111, 263; 220/22.3; 217/30, 31, 32; 108/60; 229/42

[56] References Cited

U.S. PATENT DOCUMENTS

| | | | |
|---|---|---|---|
| 518,341 | 4/1894 | Bischoff | 217/31 |
| 682,646 | 9/1901 | Scheuer | 217/31 |
| 811,158 | 1/1906 | Maddux | 217/31 |
| 1,195,183 | 8/1916 | Brown et al. | 217/31 |
| 1,785,416 | 12/1930 | Bombard et al. | 217/30 |
| 2,024,821 | 12/1935 | Hirshon | 217/31 |
| 2,366,677 | 1/1945 | Rosenthal | 108/60 |
| 2,642,183 | 6/1953 | Prossen | 229/42 |
| 3,067,903 | 12/1962 | Jones, Jr. | 220/22.3 |
| 4,153,311 | 5/1979 | Takahashi | 312/111 |

FOREIGN PATENT DOCUMENTS

| | | | |
|---|---|---|---|
| 614981 | 12/1948 | United Kingdom | 220/22.3 |
| 892643 | 3/1962 | United Kingdom | 312/234.1 |

*Primary Examiner*—Victor N. Sakran

*Attorney, Agent, or Firm*—Hill, Van Santen, Steadman & Simpson

[57] ABSTRACT

An interlocking spacer system is provided which comprises a plurality of interlocking panels which can be arranged to divide a large space into smaller compartments. The panels are made up of wall segments joined together by webs, each web having a height not more than half the height of the wall segments. This results in relieved areas between each wall segment. The webs have two pairs of opposed grooves, one pair facilitating separation of adjacent wall segments and the second pair for receiving wall edges of adjacent wall segments in an interlocking manner thereby allowing the panels to be interlocked in an end butt relationship.

7 Claims, 6 Drawing Figures

FIG.1
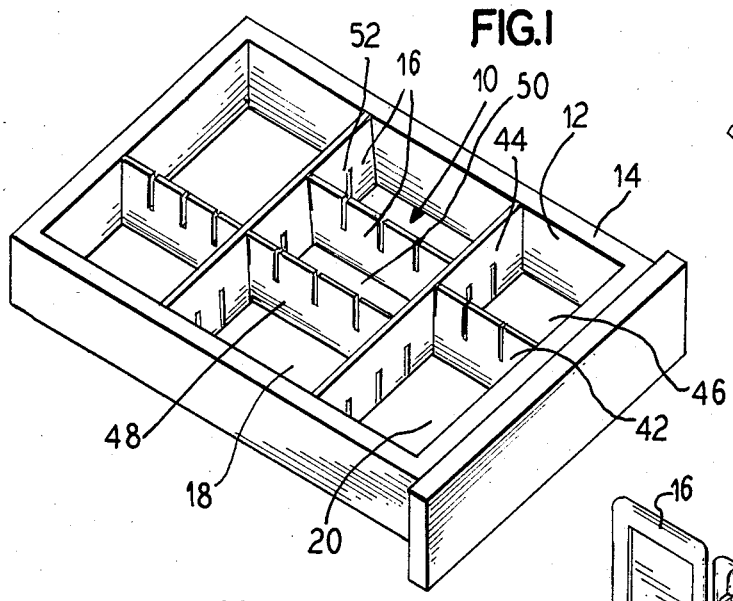
FIG.3
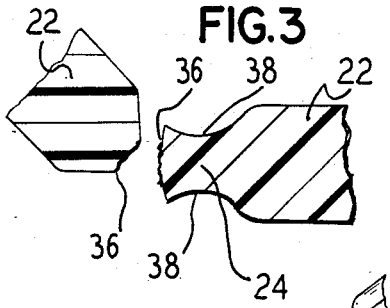
FIG.4
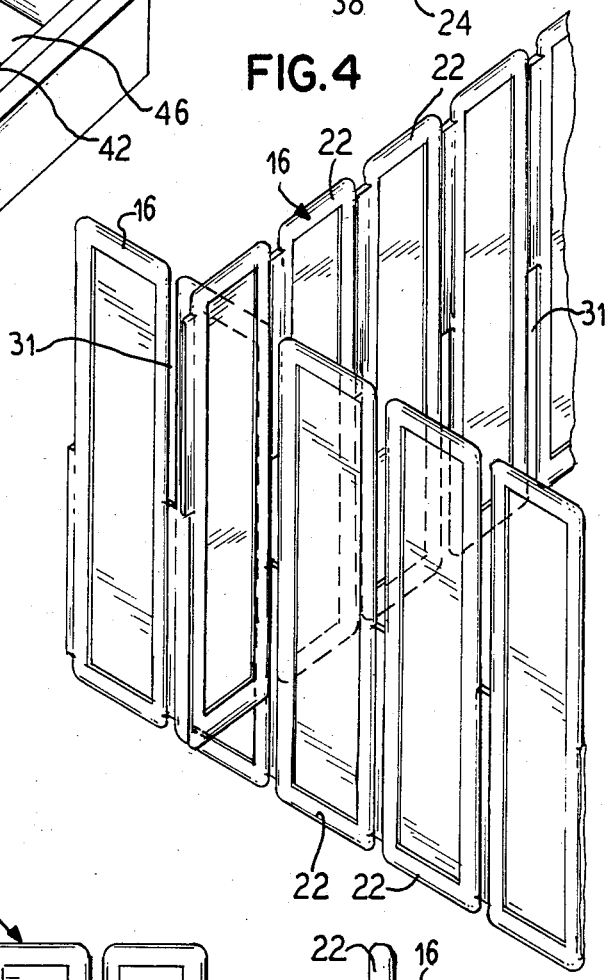
FIG.2
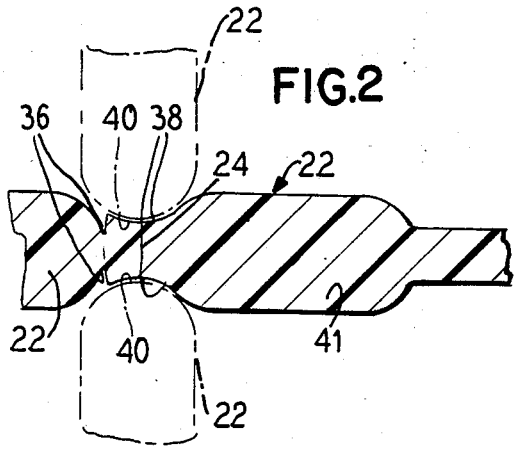
FIG.5
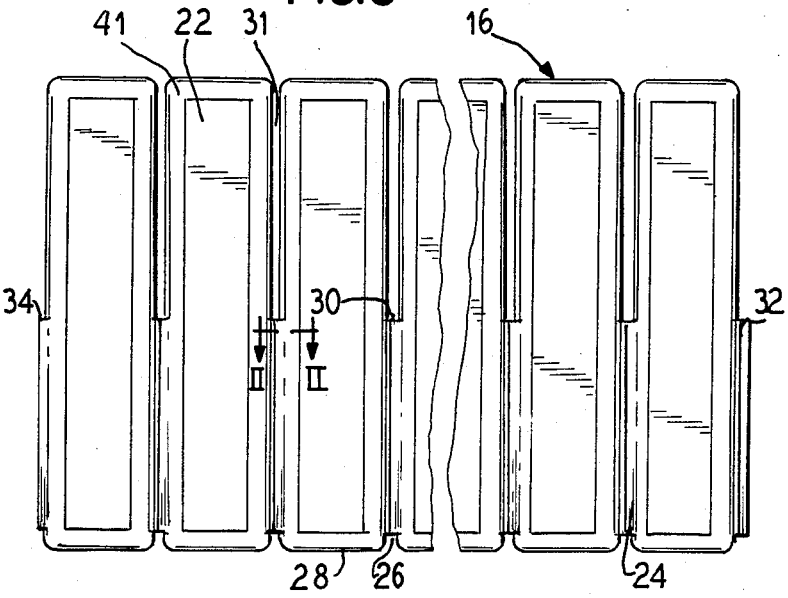
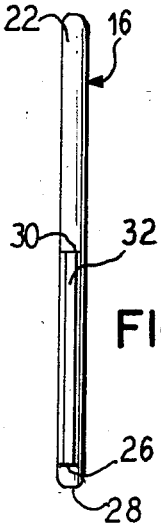
FIG.6

INTERLOCKING SPACER SYSTEM

BACKGROUND OF THE INVENTION

1. Field of the Invention

The present invention relates interlocking spacers for dividing storage areas.

2. Description of the Prior Art

Interlocking spacers are customarily used in drawers and other areas for dividing storage space into smaller compartments. Generally these interlocking spacers comprise panel members having spaced slots therein extending approximately half of the height of the panel to perpendicularly receive similar panels in an interlocking manner. With currently available spacer systems, the panels generally extend along the entire length and width of the area being divided thereby requiring that the divided storage areas have a consistent width along any particular row of compartments. Additionally, the dividers would have to be custom pre-made to fit in any particular drawer or large storage compartment and modification of a prefabricated spacer system could not be easily undertaken.

SUMMARY OF THE PRESENT INVENTION

The present invention provides a spacer system for dividing or compartmentalizing a larger storage area such as a drawer in which the spacer panels may be easily and quickly shortened to the desired length. In the panels can also be interlocked in an end butt arrangement to provide a wider range of individual compartment sizes than is presently available.

The panels comprise strips of wall segments which are attached to each other in a linear manner by thin webs which extend just less than half of the height of the strips. The webs have a groove near one edge which allow the wall segments to be snapped apart along the groove to permit the length of the strips to be shortened to a desired length.

The main body of the web has a pair of opposed broader grooves for receiving the edges of a pair of wall segments in a sliding manner. This permits the interlocking of two panels. Further, the opposed grooves in the webbing permit a strip to be interlocked with another strip in an end butt relationship.

BRIEF DESCRIPTION OF THE DRAWINGS

FIG. 1 is a perspective view of an interlocking spacer system emboding the principles of the present invention in place within a drawer.

FIG. 2 is a partial sectional view through a strip.

FIG. 3 is a partial sectional view showing two wall sections being snapped apart.

FIG. 4 is a perspective view showing two strips being interlocked.

FIG. 5 is a partial side elevational view of a strip.

FIG. 6 is an end elevational view of the strip shown in FIG. 5.

DESCRIPTION OF THE PREFERRED EMBODIMENTS

In FIG. 1 there is seen an interlocking spacer system generally at 10 in place in a large storage area 12 within a drawer 14. The spacer system 10 is comprised of a plurality of panels 16 assembled in an interlocking manner to form a plurality of smaller storage compartments such as those shown at 18 and 20.

As shown in more detail in FIGS. 5 and 6, the panels 16 are comprised of strips of wall segments 22 connected in a linear manner by webs 24. The webs 24 have a bottom end 26 slightly above a bottom end 28 of the wall segments and extend upwardly to a top end 30 which is just below half of the height of the wall segment 22, thus resulting in a space or relieved area 31 between each set of wall segments 22. Each panel 16 has a protrusion 32, 34 at either end of the panel 16; the protrusions being constructed virtually identical to the webs 24 both in height and width.

A more detailed view of the webs is shown in FIGS. 2 and 3 where it is seen that the webs 24 extend between each two wall segments 22 to connect the wall segments. A pair of opposed sharp grooves 36 is provided at one lateral edge of the webs 24 where they connect to one of the wall segments 22. These opposed grooves 36 permit the wall segments 22 to be snapped apart and separated as seen in FIG. 3. In this manner, the length of the panel 16 can be selectively shortened by a multiple of the width of a wall segment 22 to a desired length. Thus, the degree of adjustability of the length of the panel 16 is dependent on the width of each wall segment 22 and therefore, the wall segments 22 can be manufactured and in various widths to provide the desirable degree of adjustability.

The webs 24 have a second pair of opposed grooves 38 which are broader and shallower grooves than the first set of grooves 36 and which are configured to each receive a lateral edge 40 of an adjacent pair of panel segments 22.

As seen in FIGS. 2 and 5, the wall segments 22 comprise elongated planae members having a height greater than their width, which is not necessary, but it permits a more precise adjustability of the length of the panels and also a greater selection of interlocking panel placement. Each wall segment has an enlarged or thickened border 41 extending around the circumference of the wall segments which adds strength to the wall segments and panel while maximizing the strength of the panels relative to the amount of panel material used. The panel material is conveniently comprised of a hard plastic which is rigid, and which also is relatively easily broken along the grooves 36 upon a deliberate snapping action.

As seen in FIG. 4, two panels 16 can be assembled in an interlocking manner by inverting one panel with respect to the other and aligning the spaces 31 between two adjacent wall segments 22 with an identical space between two wall segments 22 on the second panel 16. As the panels 16 are pushed together, oriented at 90° to each other, the opposed edges 40 on the two adjacent wall segments 22 ride in and are captured by the opposed grooves 38 in the opposite panel 16.

The end protrusions 32, 34 are identical to a web 24 which has been snapped away from an adjoining wall segment 22. That is, each of the protrusions 32, 34 has the pair of opposed wide, shallow grooves which are configured to receive a pair of adjacent wall segments. This permits one panel to be joined to a second panel in an end butt arrangement such as is shown by panel 42 in FIG. 1. The short panel 42 is joined to a longer panel 44 which extends across the width of the drawer 14 thus dividing the front part of the drawer into two smaller compartments 20 and 46. Directly behind panel 44 are connected two additional panels 48, 50 which are also joined in an end butt relationship to panel 44. Panel 48 continues to the rear end of the drawer 14, but panel 50 terminates at a second lateral panel 52. Thus, as seen in FIG. 1, a wide variety of small compartment sizes can be configured with the interlocking panels because of the provision of the end butt interlocking webs.

As mentioned previously, the width of the wall segments can be manufactured in different sizes to change the degree of adjustability of the length of the panels 16. Further, the height of the wall segments can be manufactured in different sizes to permit the spacer system to be used in a variety of different storage spaces having widely differing heights. However, the webs 24 should always be no more than approximately half of the height of the wall segments in order to allow a complete interlocking of two panels and to permit the top of the two interlocked panels to be flush after the panels are interlocked together.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An interlocking spacer system for use in dividing an area into a number of smaller compartments comprising:

a plurality of panels, said panels each comprising a plurality of wall segments joined together in a linear arrangement by webs, said wall segments comprising rectangular planar members and said web connections occuring along the height of said wall segments;

said webs having a first end closely adjacent a first end of two adjacent wall segments and a second end approximately half way along the height of said wall segments, said webs further having two pairs of opposed grooves, a first pair being sharp and deep, facilitating separation of said two adjacent wall segments along said grooves, said second pair being wide and shallow to receive a pair of opposed side walls of an adjacent pair of wall segments of another panel, said panels including a web-like protrusion at at least one end thereof, each with a single pair of opposed grooves identical to said wide and shallow grooves to permit one of said panels to be interlocked with another of said panels in an end butt arrangement, whereby said panels interlock by means of said opposed side walls engaging said second pair of grooves.

2. The device of claim 1 wherein said wall segments have a height greater than their width.

3. The device of claim 1 wherein said wall segments have a thickened peripheral border.

4. An interlocking spacer system for use in dividing an area within a drawer into a number of smaller compartments comprising:

a plurality of panels each having a height permitting said panels to be accomodated in said drawer, said panels each comprising a plurality of wall segments joined together in a linear arrangement by webs, said webs having a first and closely adjacent a first end of two adjacent wall segments and a second end no farther than approximately half way along the height of said wall segments, said webs further having two pairs of opposed grooves, a first pair being sharp and deep, facilitating separation of said two adjacent wall segments along said grooves, said second pair being wide and shallow to receive a pair of opposed side walls of an adjacent pair of wall segments of another panel, said panels including a web-like protrusion at at least one end thereof, each with a single pair of opposed grooves identical to said wide and shallow grooves to permit one of said panels to be interlocked with another of said panels in an end butt arrangment, whereby said panels interlock by means of said opposed side walls engaging said second pair of grooves.

5. The device of claim 4 wherein said wall segments comprise rectangular planar members and said web connections occur along the height of said wall segments.

6. The device of claim 4 wherein said wall segments have a height greater than their width.

7. The device of claim 4 wherein said wall segments have a thickened peripheral border.

* * * * *